US011253982B2

(12) United States Patent
Quicke

(10) Patent No.: US 11,253,982 B2
(45) Date of Patent: Feb. 22, 2022

(54) TORQUE WRENCH AND REACTION ARM ASSEMBLY

(71) Applicant: Enerpac UK Ltd, Northumberland (GB)

(72) Inventor: Stephen Quicke, Northumberland (GB)

(73) Assignee: Enerpac UK Ltd, Morpeth (GB)

( * ) Notice: Subject to any disclaimer, the term of this patent is extended or adjusted under 35 U.S.C. 154(b) by 183 days.

(21) Appl. No.: 16/477,990

(22) PCT Filed: Jan. 15, 2018

(86) PCT No.: PCT/GB2018/050102
§ 371 (c)(1),
(2) Date: Jul. 15, 2019

(87) PCT Pub. No.: WO2018/130854
PCT Pub. Date: Jul. 19, 2018

(65) Prior Publication Data

US 2020/0122305 A1 Apr. 23, 2020

(30) Foreign Application Priority Data

Jan. 13, 2017 (GB) ..... 1700597.6

(51) Int. Cl.
*B25B 23/00* (2006.01)
*B25B 21/00* (2006.01)
*B25B 23/145* (2006.01)

(52) U.S. Cl.
CPC ..... *B25B 23/0078* (2013.01); *B25B 21/005* (2013.01); *B25B 23/0007* (2013.01); *B25B 23/145* (2013.01)

(58) Field of Classification Search
CPC ..... B25B 23/0078; B25B 23/0007; B25B 23/145; B25B 23/00; B25B 13/08;
(Continued)

(56) References Cited

U.S. PATENT DOCUMENTS 1,516,099 A * 11/1924 Hill ..... B25B 15/02 7/170
4,982,626 A * 1/1991 More ..... B25B 21/005 81/57.39

(Continued)

FOREIGN PATENT DOCUMENTS

DE 10236586 A1 2/2004

OTHER PUBLICATIONS

International Search Report with Written Opinion for related Application No. PCT/GB2018/050102 dated May 18, 2018 (7 Pages).

(Continued)

*Primary Examiner* — Robert J Scruggs
(74) *Attorney, Agent, or Firm* — Michael Best & Friedrich LLP

(57) ABSTRACT

A torque wrench assembly comprises a torque wrench and a reaction arm and locking means for locking together the torque wrench and the reaction arm. The locking means comprises a connection member located on the torque wrench; an opening on the reaction arm for receipt of the connection member of the torque wrench; a locking member slidably mounted in a channel on the reaction arm, the locking member including an aperture sized to allow the connection member to pass therethrough; and biasing means arranged to bias the locking member into a position wherein the aperture is partially aligned with the opening. The connection member has an insertion end for insertion into the opening of the reaction arm, and immediately adjacent the insertion end is a recess. The recess is shaped to receive a part of the locking member.

10 Claims, 8 Drawing Sheets

(58) Field of Classification Search
CPC ..... B25B 13/48; B25B 13/56; B25B 21/005; B25B 21/004; B25B 13/463; B25B 21/002; B25B 21/00; G09F 3/00
See application file for complete search history.

(56) References Cited

U.S. PATENT DOCUMENTS 6,068,068 A * 5/2000 Turoff ..... B25B 21/005 173/218
7,062,993 B2 * 6/2006 Shaw ..... B25B 21/005 81/54

OTHER PUBLICATIONS

Examination Report issued from the European Patent Office for related Application No. 18706544.6 dated Apr. 6, 2021 (4 Pages).

* cited by examiner

TORQUE WRENCH AND REACTION ARM ASSEMBLY

FIELD OF THE INVENTION

The present invention relates to torque wrenches and in particular a type of torque wrench mounting a reaction arm and a quick-release mechanism for locking together the torque wrench and reaction arm.

BACKGROUND OF THE INVENTION

Hydraulic torque wrenches are used widely, particularly in the oil and gas industries. Torque wrenches require some form of reaction member or reaction arm that engages with an immovable object to prevent the wrench from spinning about the component that is to be tightened or loosened.

GB2524825 describes a torque wrench which couples to a reaction arm using a quick release mechanism incorporating ball bearings which locate in a groove.

This type of quick release mechanism requires the user to depress a button before connecting the reaction arm to the wrench. If the button is not depressed prior to assembly this leads to improper assembly and/or damage to the component parts. We have also found that this prior art locking mechanism doesn't always engage properly.

It would therefore be desirable to provide an improved torque wrench and an improved quick release mechanism for connection with a reaction arm.

SUMMARY OF THE INVENTION

According to the invention there is provided a torque wrench assembly comprising a torque wrench and a reaction arm and locking means for locking together the torque wrench and the reaction arm, wherein the locking means comprises:

a connection member located on either one of the torque wrench or the reaction arm;

an opening on a respective other one of the torque wrench and the reaction arm for receipt of the connection member of the torque wrench and a locking member slidably mounted in a channel on said torque wrench or reaction arm, the locking member including an aperture sized to allow the connection member to pass therethrough;

and biasing means arranged to bias the locking member into a position wherein the aperture is partially aligned with the opening;

wherein the connection member includes a recess, and wherein both the locking member and the recess are shaped and dimensioned such that the locking member is a sliding fit in the recess.

Insertion of the connection member into the opening causes the locking means to slide inwards, against the force of the biasing means. This aligns the aperture with the opening and allows the insertion end of the connection member to pass through the aperture. Once the insertion end of the connection member has passed through aperture, the locking means is biased into a locked position where it engages with the recess on the connection member such that the aperture is no longer aligned with the opening.

The aperture of the locking member preferably has a chamfered edge.

The insertion end of the connection member is preferably tapered in shape.

The biasing means may be a spring.

The reaction arm may further comprise a hole into which the connection member locates.

Preferably, the connection member is located on the torque wrench and the locking member is located on the reaction arm.

BRIEF DESCRIPTION OF THE DRAWINGS

In the Drawings, which illustrate the prior art and preferred embodiments of a torque wrench according to the invention.

DETAILED DESCRIPTION OF THE PRIOR ART AND PREFERRED EMBODIMENTS OF THE INVENTION

Figure 1:
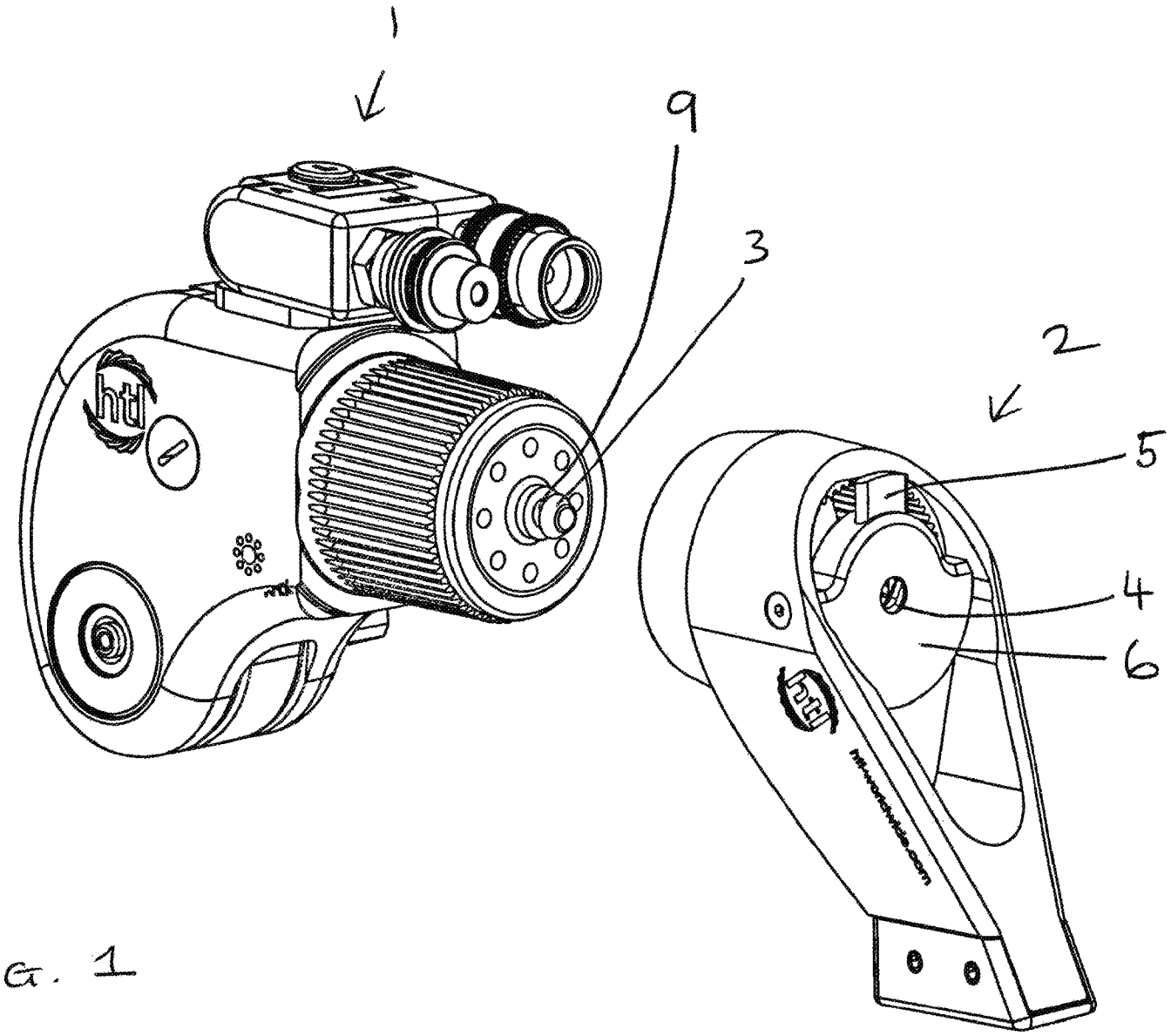
FIG. 1 is a schematic representation of a hydraulic torque wrench and a reaction arm prior to assembly.

FIG. 1 illustrates a torque wrench 1 and a reaction arm 2. The torque wrench 1 is provided with a connection member 3 and the reaction arm 2 includes an opening 12 (see FIG. 7*a*) for receiving the connection member 3. In the illustrated embodiment the reaction arm 2 also includes a back plate 6 with a hole 4 therein, into which the connection member 3 locates, although this is not essential, for example a hollow portion inside the reaction arm would suffice for receiving the end of the connection member 3. The reaction arm 2 includes a locking member 5 which is slidably mounted in a channel 10. The locking member 5 includes an aperture 7 sized to allow the connection member 3 to pass therethrough.

Figure 7B:
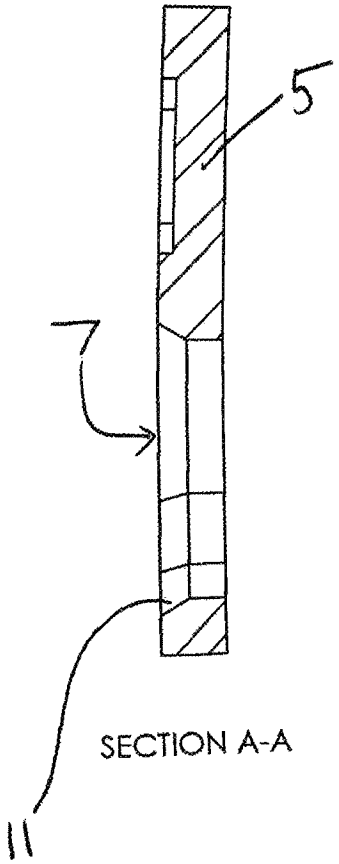
FIG. 7*b* is a cross-sectional view of the locking member of FIG. 7*a*, along the line A-A
Figure 7A:
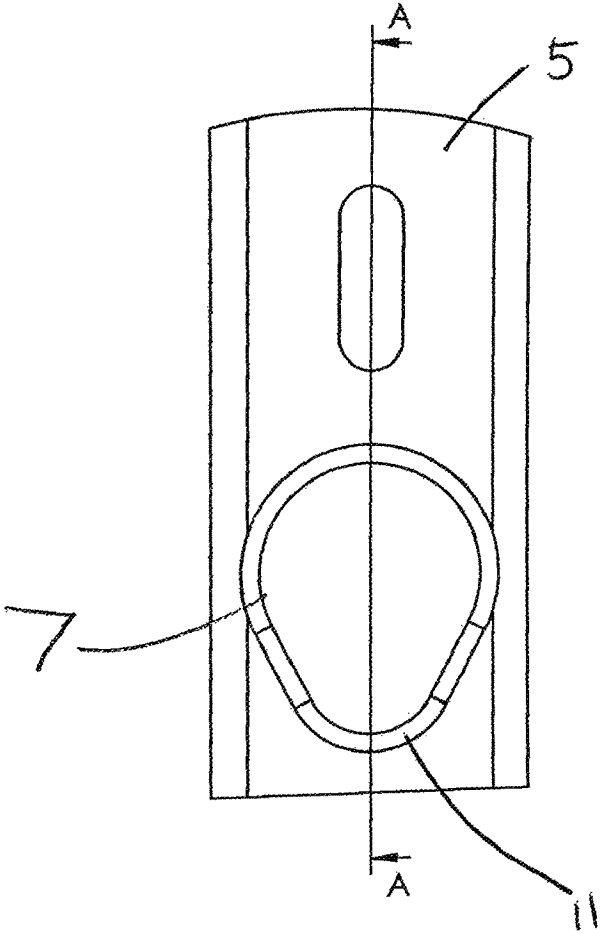
FIG. 7*a* is a schematic representation of a locking member component part of a reaction arm.
Figure 8:
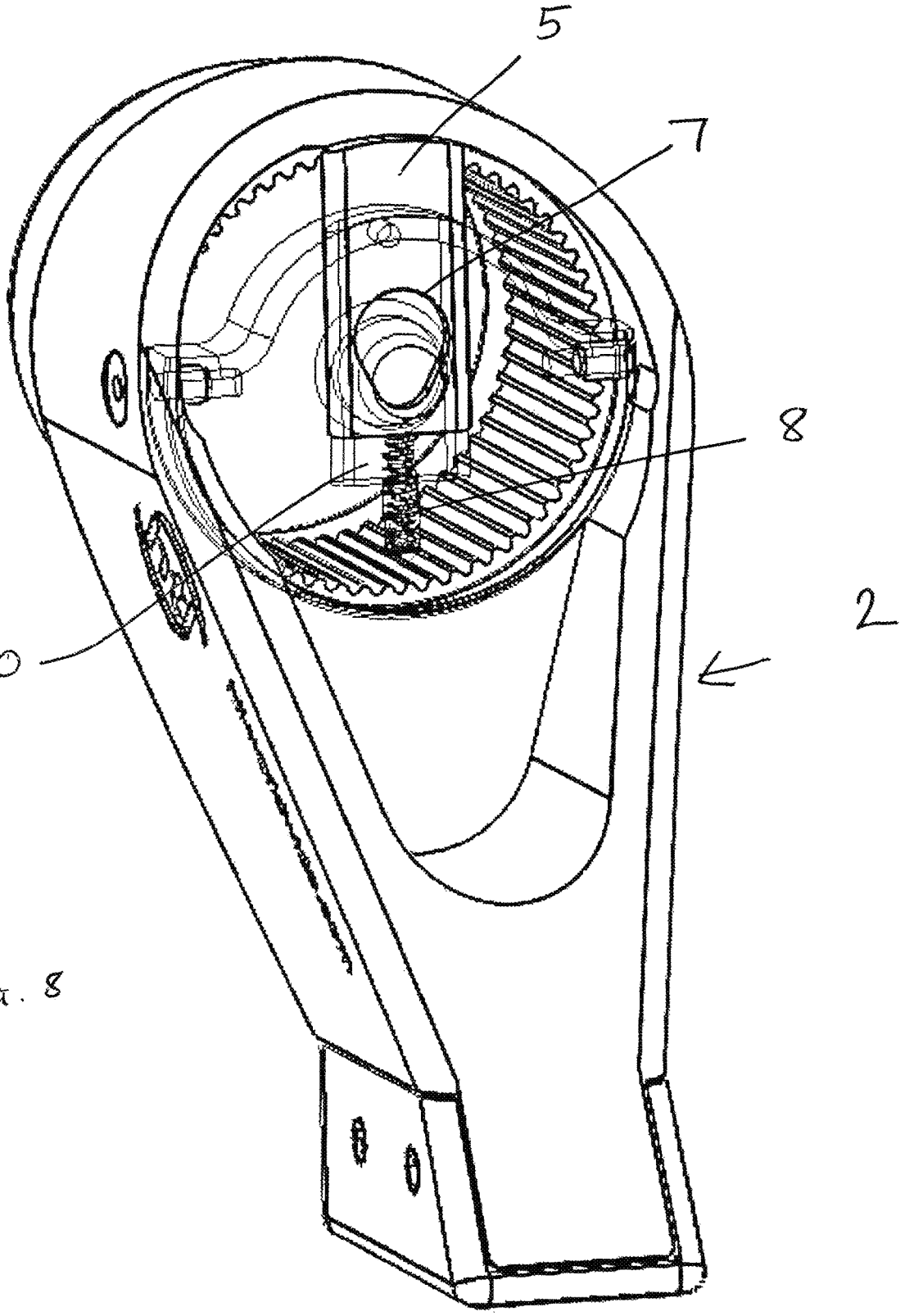
FIG. 8 is a schematic representation of the reaction arm of FIG. 1 with the end plate removed.

As shown in FIGS. 7*a* and 7*b*, the edge 11 of the aperture 7 is preferably chamfered. The end of the connector member 3 is preferably tapered as illustrated.

The locking member 5 has an upper end which protrudes from the reaction arm 2, as shown in the drawings, and a lower end which is connected to a spring 8. The spring is arranged to bias the locking member 5 towards the reaction arm 2. When the locking member 5 is at rest the aperture 7 is partially overlaps with opening for receiving the connection member 3.

The locking member 5 is shown in more detail in FIGS. 7*a* and 7*b*. The aperture is preferably roughly the shape of an inverted pear, with a first region of larger diameter and a second region of smaller diameter. The edge 11 of the aperture 7 with which the connection member 3 first engages is preferably chamfered.

Figure 5:
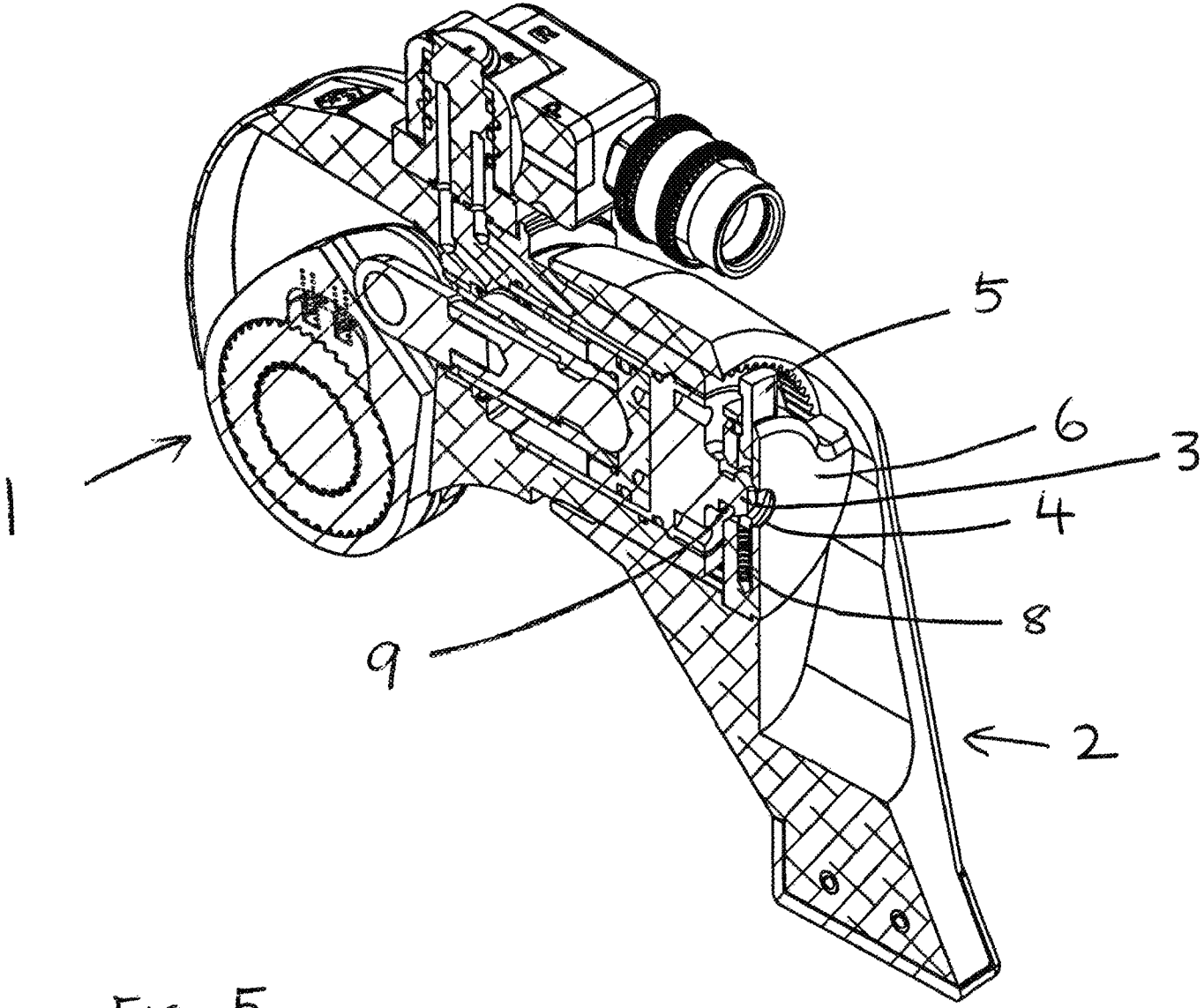
FIG. 5 is a vertical cross-sectional view of the torque wrench assembly of FIG. 2 shown just prior to the engagement of the locking member.
Figure 6A:
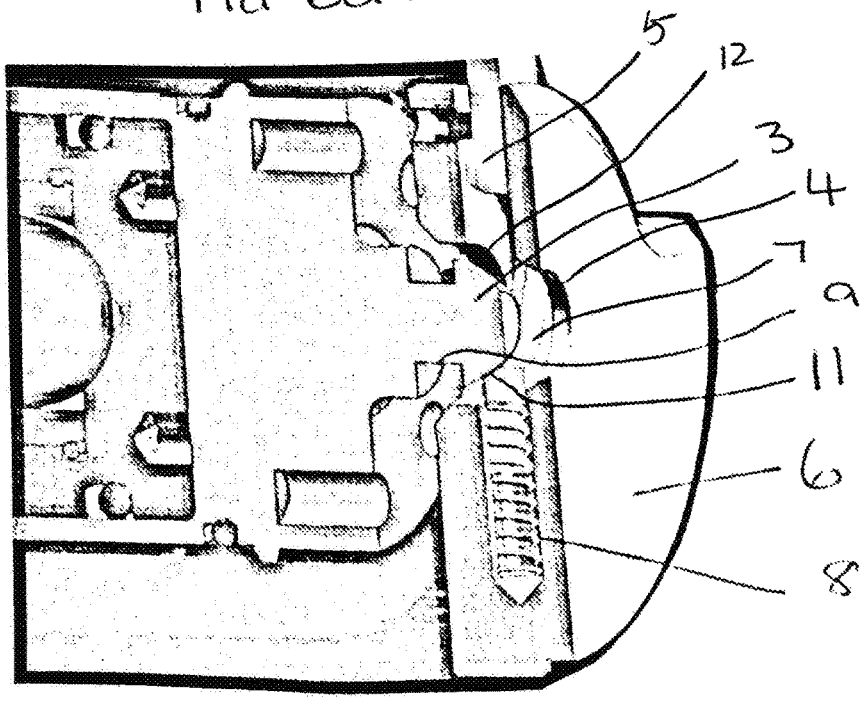
FIG. 6*a* is a close up schematic representation of the locking means of the torque wrench assembly shown just prior to the engagement of the locking member.

As shown in FIGS. 5 and 6*a*, when the connection member 3 of the torque wrench 1 is pushed into the opening 12 of the reaction arm 2, the end of the connection member 3 pushes down on the chamfered edge 11 of the aperture 7 which then pushes the locking member 5 downwards against the force of the spring 8. The part of the aperture 7 with larger diameter is now aligned with the opening 12, allowing the end of the connection member 3 to pass through the aperture 7 and locate in the hole 4 in the back plate 6. The connection member 3 includes a recess 9 located adjacent to the tapered end, the recessed part 9 having a diameter which is smaller than the insertion end of the connection member 3 and shaped to receive part of the locking member 5.

Figure 2:
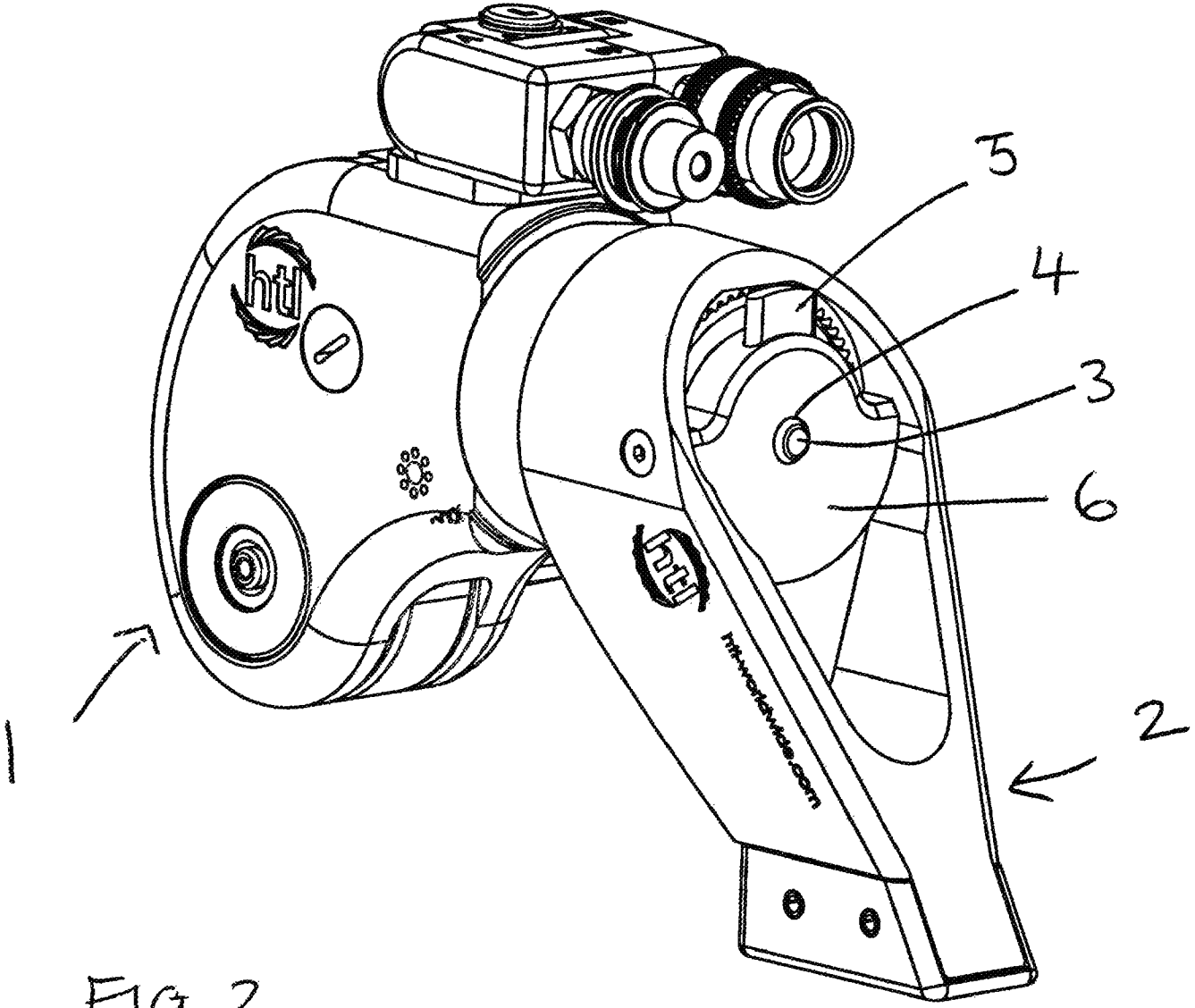
FIG. 2 is a schematic representation of the assembled hydraulic torque wrench and a reaction arm of FIG. 1.
Figure 3:
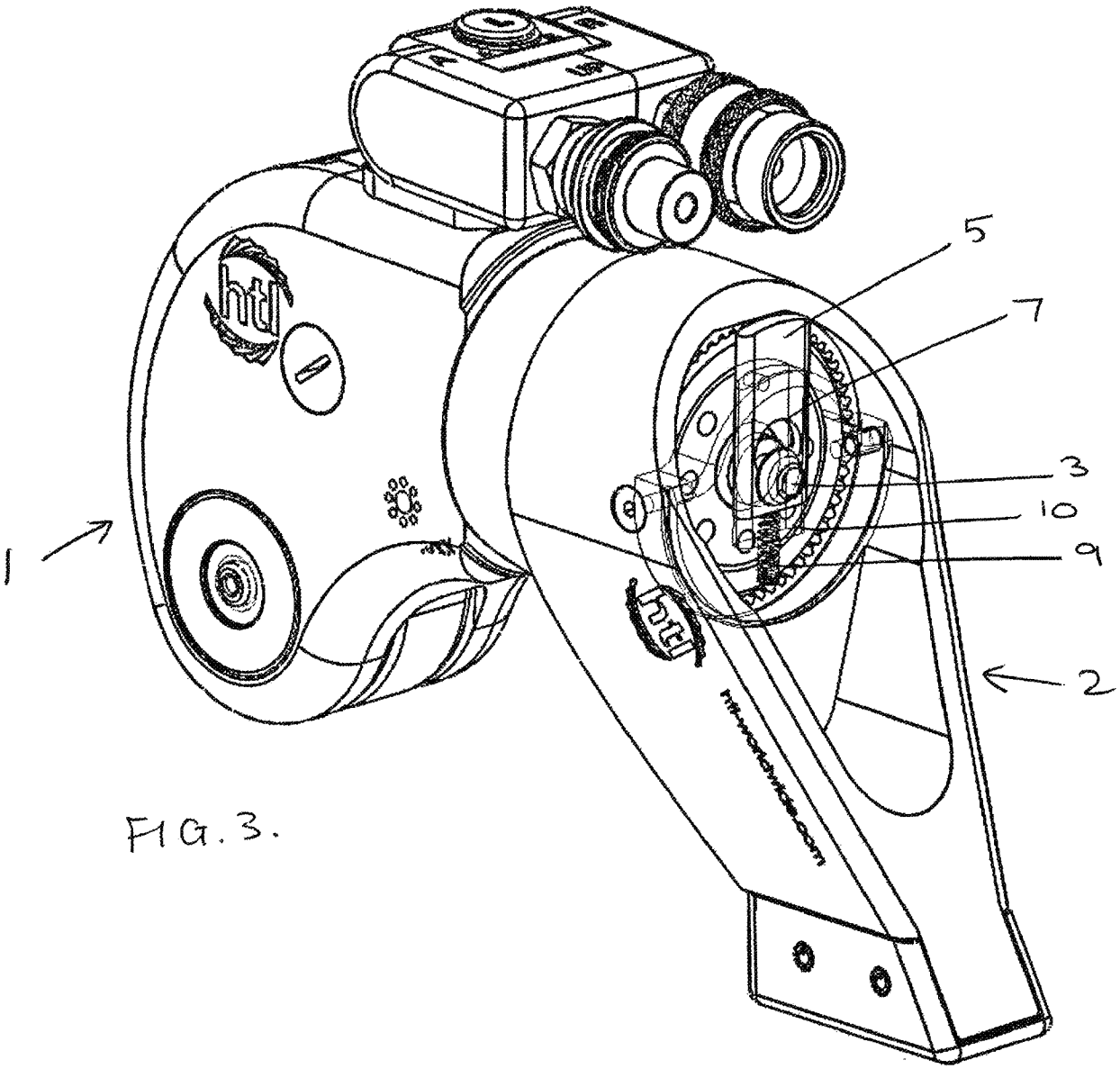
FIG. 3 is a schematic representation of the assembled hydraulic torque wrench and a reaction arm of FIG. 2, shown with the end plate of the reaction arm removed.
Figure 4:
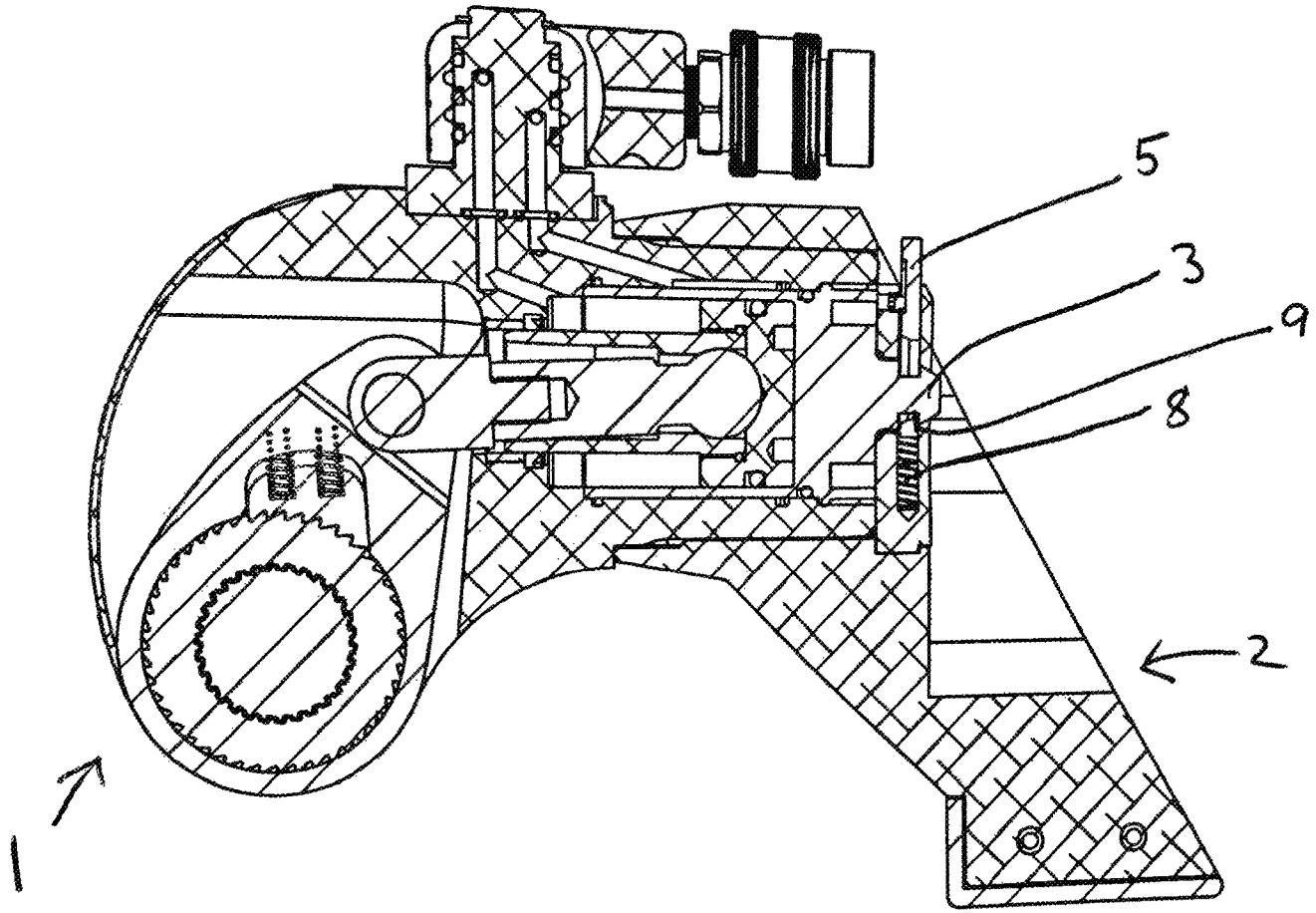
FIG. 4 is a vertical cross-sectional view of the torque wrench assembly shown in FIG. 2.
Figure 6B:
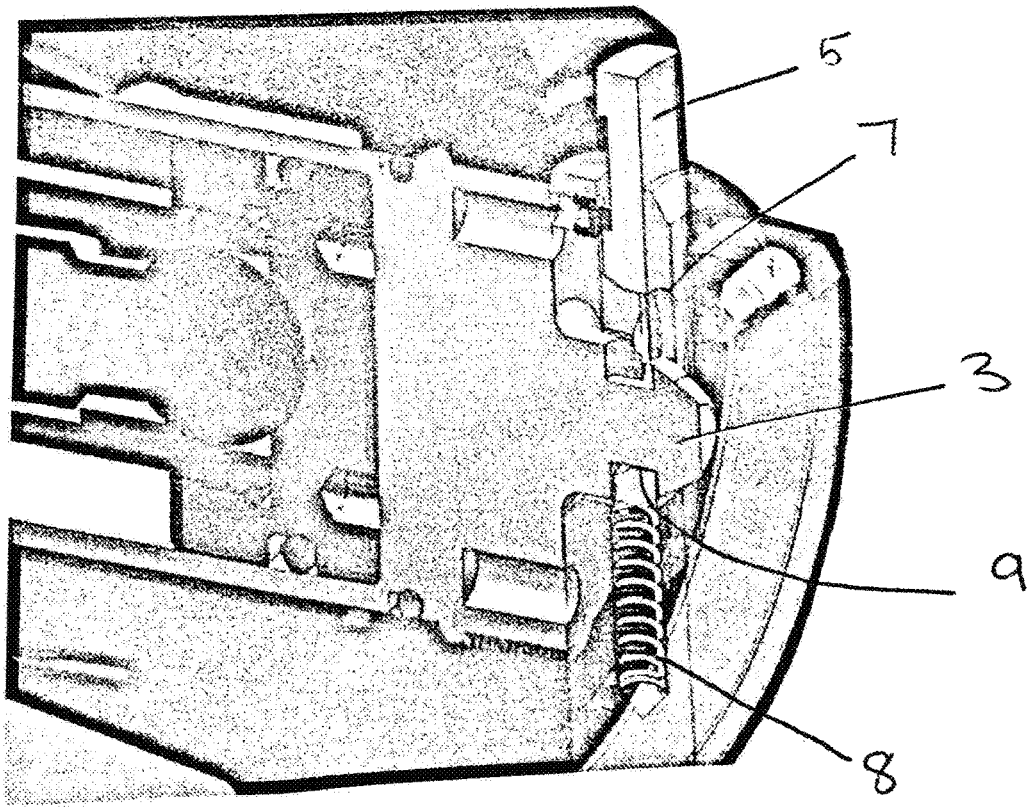
FIG. 6*b* is a close up schematic representation of the locking means of the torque wrench assembly shown after the engagement of the locking member.

As shown in FIGS. 3, 4 and 6*b*, once the tapered end of the connection member 3 has passed through the aperture 7 of the locking member 5, the locking member 5 springs up automatically and locks into the recess 9 behind the end of the connection member 3 due to the force exerted by the spring. The torque wrench 1 and reaction arm 2 are now securely locked together since the aperture 7 of the locking member is not aligned with the opening 12 on the reaction arm and the two devices cannot be unlocked without some manual intervention. FIG. 2 illustrates the two devices locked together.

To unlock the two devices, the user simply presses down on the upper end of the locking member 5, and this causes the locking member 5 to slide towards the spring and causes the aperture 7 to fully align with the first opening allowing the connection member 3 of the torque wrench 1 to be withdrawn from the reaction arm 2, uncoupling the two devices.

The torque wrench assembly of the invention provides an improved mechanism for securely locking together a torque wrench and a reaction arm without the requirement for user input prior to assembly of the two devices.

The invention claimed is:

1. A torque wrench assembly comprising a torque wrench and a reaction arm and locking means for locking together the torque wrench and the reaction arm, wherein the locking means comprises:

a connection member having an end with an end diameter and located on either one of the torque wrench or the reaction arm;

an opening on a respective other one of the torque wrench and the reaction arm for receipt the end of the connection member and a locking member slidably mounted in a channel on said torque wrench or reaction arm, the locking member including an aperture sized to allow the connection member to pass therethrough, the aperture having a first portion with a first diameter larger than the end diameter and a second portion with a second diameter less than the end diameter;

and biasing means arranged to bias the locking member into a position wherein the aperture of the locking member is partially aligned with the opening;

wherein the connection member includes a recess, and wherein both the locking member and the recess are shaped and dimensioned such that the locking member is a sliding fit in the recess.

2. A torque wrench assembly according to claim 1, wherein the aperture of the locking member has a chamfered edge.

3. A torque wrench assembly according to claim 2, wherein the end of the connection member is tapered in shape, and wherein, during connection of the reaction arm and the torque wrench, the chamfered edge of the aperture is engageable with the tapered end of the connection member to move the locking member against the bias of the biasing member.

4. A torque wrench assembly according to claim 1, wherein the end of the connection member is tapered in shape.

5. A torque wrench assembly according to claim 1, wherein the biasing means is a spring.

6. A torque wrench assembly according to claim 1, wherein the connection member is located on the torque wrench and the locking member is located on the reaction arm.

7. A torque wrench assembly according to claim 6, wherein the reaction arm has a reaction end engageable with an object and an opposite end, and wherein the locking member has a member end engageable by a user to move the locking member against the bias of the biasing member, the member end being proximate the opposite end of the reaction arm and projecting away from the reaction end.

8. A torque wrench assembly according to claim 1, wherein the aperture tapers from the first diameter to the second diameter.

9. A torque wrench assembly according to claim 1, wherein the connection member defines a recess having a recess diameter less than the end diameter, the recess receiving the second portion of the aperture.

10. A torque wrench assembly according to claim 9, wherein the recess diameter is approximately the same as the second diameter.

* * * * *